US010478886B2

(12) United States Patent
Hirata

(10) Patent No.: US 10,478,886 B2
(45) Date of Patent: Nov. 19, 2019

(54) STAMPING METHOD AND STAMPING APPARATUS

(71) Applicant: TOYOTA BOSHOKU KABUSHIKI KAISHA, Aichi-ken (JP)

(72) Inventor: Kazuyuki Hirata, Toyota (JP)

(73) Assignee: TOYOTA BOSHOKU KABUSHIKI KAISHA, Aichi-Ken (JP)

( * ) Notice: Subject to any disclaimer, the term of this patent is extended or adjusted under 35 U.S.C. 154(b) by 335 days.

(21) Appl. No.: 14/567,375

(22) Filed: Dec. 11, 2014

(65) Prior Publication Data

US 2015/0174635 A1 Jun. 25, 2015

(30) Foreign Application Priority Data

Dec. 20, 2013 (JP) ..... 2013-264158

(51) Int. Cl.
*B21D 28/00* (2006.01)
*B21D 28/16* (2006.01)

(52) U.S. Cl.
CPC ..... *B21D 28/16* (2013.01)

(58) Field of Classification Search
CPC ..... B21D 28/16; B21D 28/00; B21D 22/02; B21D 53/28; B21D 45/02; B21D 28/10; B21D 28/02; B21D 28/22; B21D 22/06; B21D 35/001; B21J 5/12; B21K 1/30; B23P 15/14
USPC ..... 72/404
See application file for complete search history.

(56) References Cited

U.S. PATENT DOCUMENTS

| | | | | |
|---|---|---|---|---|
| 4,739,644 | A * | 4/1988 | Maki | B21K 1/30 29/893.34 |
| 6,442,990 | B1 | 9/2002 | Komatsu et al. | |
| 6,907,764 | B2 * | 6/2005 | Ushida | B21D 53/28 29/893.36 |
| 7,296,456 | B2 * | 11/2007 | Ushida | B21K 1/30 72/335 |
| 2004/0187547 | A1 | 9/2004 | Ushida | |
| 2009/0025450 | A1 * | 1/2009 | Fujimura | B21D 53/28 72/377 |
| 2012/0240405 | A1 * | 9/2012 | Iwata | B21D 53/28 29/893.34 |

FOREIGN PATENT DOCUMENTS

| | | |
|---|---|---|
| DE | 4418632 | * 12/1994 |
| JP | 2001-170721 | 6/2001 |
| JP | 2004-291007 | 10/2004 |
| JP | 2005-74454 | 3/2005 |
| JP | 2007-038292 | 2/2007 |

OTHER PUBLICATIONS

Machine Translation of DE4418632 to Nakamura et al., Dec. 1994.*
Japanese Office Action for JP App. No. 2013-264158 dated Jan. 24, 2017, along with English-language translation thereof.

* cited by examiner

*Primary Examiner* — Debra M Sullivan
(74) *Attorney, Agent, or Firm* — Greenblum & Bernstein, P.L.C.

(57) ABSTRACT

A recess is formed in a plate-like workpiece. Then, an inner ejector is engaged with the recess to restrict deformation of a body portion. In this state, a flange is formed in the outer periphery of the workpiece. A processed product portion is then punched out.

5 Claims, 10 Drawing Sheets

Clamped State

Top Dead center State

Stamping-Completed State

Middle State of Stamping

Clamped State

Top Dead center State

Stamping-Completed State

Middle State of Stamping

STAMPING METHOD AND STAMPING APPARATUS

BACKGROUND OF THE INVENTION

The present invention relates to a stamping method and a stamping apparatus for forming a processed product having a desired shape from a workpiece.

A technique related to stamping is disclosed in Japanese Laid-Open Patent Publication No. 2007-38292. In this conventional technique, a workpiece 100 is processed by the procedure illustrated in FIGS. 17 to 20. First, as illustrated in FIGS. 17 and 18, an upper die base 200 is lowered to press an ejector 121, a stripper 122, and a punch 123 against the top surface of a workpiece 100. A lower die base 300 includes an outer die 112 and an inner die 111. The height of the inner die 111 is small compared to the height of the outer die 112 such that a step 114 is formed between the top surface of the die 111 and the top surface of the die 112.

With reference to FIGS. 19 and 20, the upper die base 200 is continuously lowered together with an ejector 113 of a lower die base 300, which is urged upward by springs 115. In this manner, a processed product portion 110 is formed in the workpiece 100. In this state, the processed product portion 110 includes a flange 102, a body portion 103, and an inner joint portion 108 between the flange 102 and the body portion 103. The processed product portion 110 is connected to the flange 102 through an outer joint portion 109. The processed product portion 110 includes the flange 102 corresponding to an outer periphery and the body portion 103 corresponding to a central portion, which are formed with the joint portion 108 located between the flange 102 and the body portion 103. A recess 104 is formed in the body portion 103.

Then, after the upper die base 200 is raised to release the workpiece 100 from shaping pressure, the outer joint portion 109 is sheared to separate the processed product portion 110 from the workpiece 100, thus completing a processed product, in non-illustrated subsequent steps.

As has been described, in the technique described in Japanese Laid-Open Patent Publication No. 2007-38292, an outer peripheral portion of the processed product portion 110 is sheared at a position between the upper die base 200 and the lower die base 300, which are selectively lifted and lowered at a predetermined stroke, and the recess 104 is formed at an inner side of the processed product portion 110. Accordingly, in the stamping-completed state illustrated in FIG. 20, the thickness of the joint portion 108 between the recess 104 and the flange 102 needs to be great compared to the thickness of the outer joint portion 109, which will be sheared. To satisfy such need, the height of the inner die 111 is set small compared to the height of the outer die 112 to ensure a step 114 between the dies 111, 112 of the lower die base 300. As illustrated in FIGS. 18 and 19, the step 114 causes delay in stamping of a portion corresponding to the joint portion 108, which is close to the recess 104, compared to stamping of a portion corresponding to the joint portion 109, which will be sheared. As a result, the thickness of the inner joint portion 108 becomes great compared to the thickness of the outer joint portion 109.

However, the step 114 forms a gap between the workpiece 100 and the inner die 111 at an early stage of stamping, as illustrated in FIG. 18. This allows deformation of the workpiece 100 inside the gap. Accordingly, the workpiece 100 may deform and cause the processed product portion 110, or, particularly, the body portion 103, to be processed in a bent state. Such deformation may remain in the processed product after stamping or the processed product may recover from the deformation after the stamping. In these cases, errors may be caused in the shape and the size of the processed product compared to the desired shape or the desired size. This decreases accuracy of the processed product.

SUMMARY OF THE INVENTION

Accordingly, it is an objective of the present invention to provide a stamping method or a stamping apparatus capable of ensuring highly accurate stamping.

To achieve the foregoing objective and in accordance with one aspect of the present invention, a forming method is provided to stamp a plate-like workpiece with a stamping apparatus to obtain a processed product having a body portion, an outer peripheral portion formed in an outer periphery of the body portion, and a recess formed between the body portion and the outer peripheral portion. The method includes: a first step of forming the recess in the workpiece; a second step of engaging a restraint member with the recess; and a third step of forming the outer peripheral portion while restricting deformation of the body portion by means of the restraint member.

The portion corresponding to the recess is restrained by the restraint member. As a result, even when shaping pressure is applied to the workpiece after the recess is formed, the body portion of the processed product in the workpiece substantially is not deformed. The stamping method thus obtains a processed product with improved accuracy.

DETAILED DESCRIPTION OF THE PREFERRED EMBODIMENTS

One embodiment of the present invention will now be described.

A processed product formed according to one embodiment will now be described.

Figure 1:
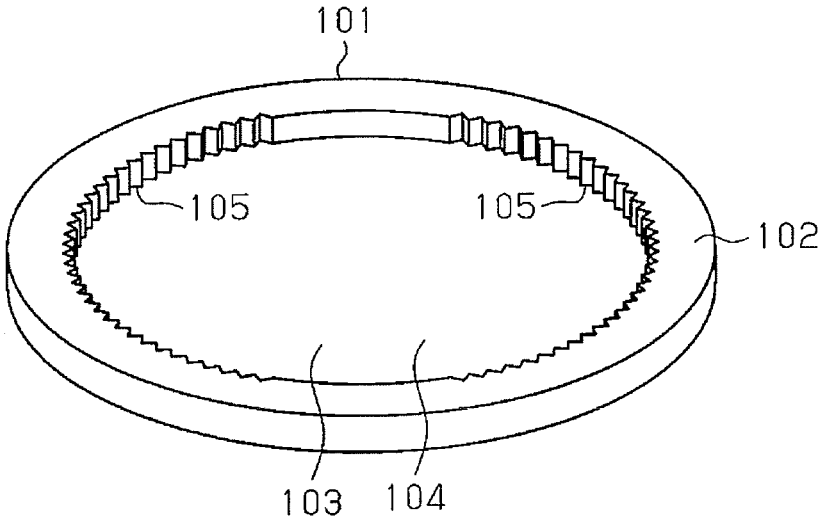
FIG. 1 is a perspective view showing a processed product obtained through stamping.
Figure 2:
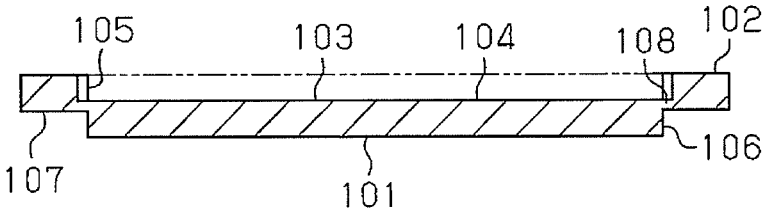
FIG. 2 is a cross-sectional view showing the processed product illustrated in FIG. 1.

As illustrated in FIGS. 1 and 2, a processed product 101, which is formed by stamping a plate-like workpiece, has a circular form as a whole. The processed product 101 includes a flange 102, a body portion 103, and a recess 104. The flange 102 is formed in the outer periphery of the processed product 101. The body portion 103 is arranged at the center of the processed product 101. The recess 104 is formed in the body portion 103. Two ratchets 105, each of which is configured by a number of projections and recesses, are formed in the inner wall surface of the recess 104.

A stamping apparatus will hereafter be described. In the present embodiment, the processed product 101 is manufactured through steps using three types of stamping presses 1, 2, and 3. A first stamping press 1, a second stamping press 2, and a third stamping press 3 are shown in FIGS. 3 to 6 and 8, FIGS. 9 to 12 and 14, and FIGS. 15 and 16, respectively.

The configuration of the first stamping press 1 will first be described. With reference to FIGS. 3 to 6 and 8, the first stamping press 1 has a fixed lower die base 11. A die 13, which has a circular form as viewed from above and is used to form the recess 104 of the processed product 101, is fixed to the top surface of a support table 12 of the lower die base 11. Teeth 14 are formed in the outer periphery of the die 13 to form the ratchets 105 in the processed product 101. An annular stripper 15 is arranged around the outer periphery of the die 13 to be movable in the vertical direction. The stripper 15 is supported by the support table 12 using elastic force of a plurality of elastic members 16, which are springs or gas springs. The bottom dead center position of the stripper 15 is defined by a stopper 17.

Figure 3:
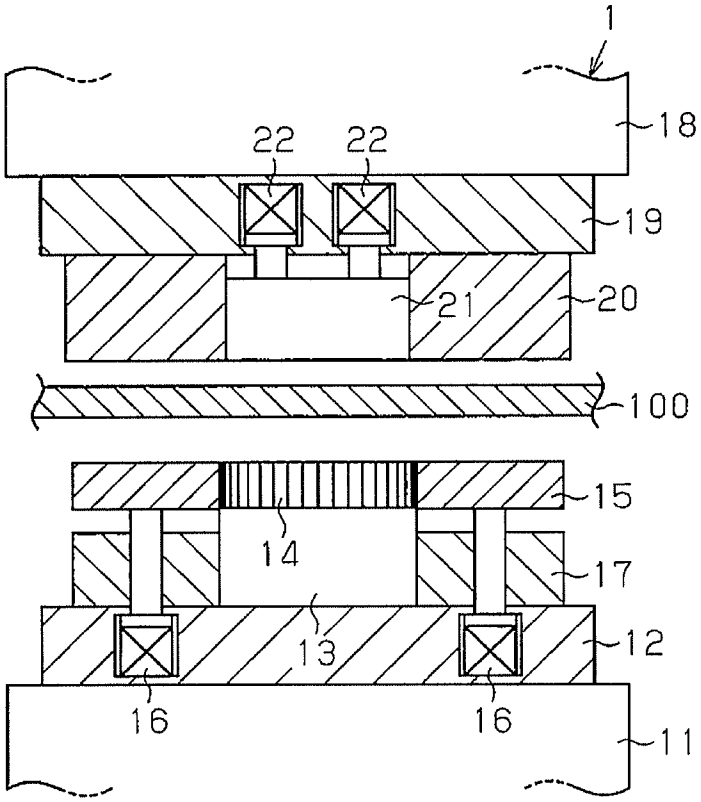
FIG. 3 is a cross-sectional view illustrating a first stamping press in a state in which an upper die base is at a top dead center position.
Figure 6:
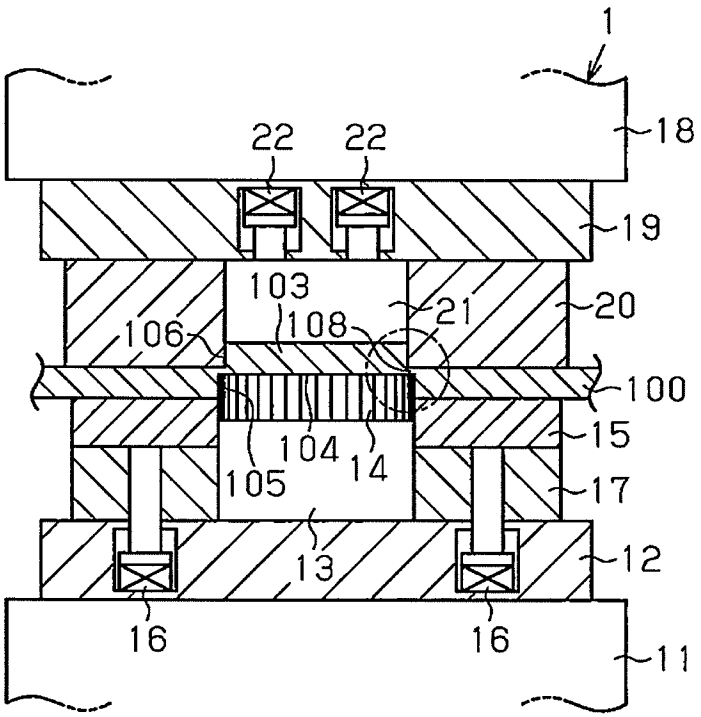
FIG. 6 is a cross-sectional view illustrating the first stamping press in a state in which the stamping of the workpiece is completed.

An upper die base 18 of the first stamping press 1 is selectively lifted and lowered between the top dead center position illustrated in FIG. 3 and the bottom dead center position illustrated in FIG. 6 by a non-illustrated drive mechanism. An annular die 20 opposed to the stripper 15 is fixed to the bottom surface of a support table 19 of the upper die base 18. A columnar ejector 21 opposed to the die 13 is arranged along the inner periphery of the die 20 to be movable in the vertical direction. The ejector 21 is supported by the support table 19 through a plurality of elastic members 22. Each of the elastic members 22 is configured identically with each of the elastic members 16.

As illustrated in FIGS. 9 to 12 and 14, the second stamping press 2 includes a lower die base 31 serving as a first die base. An annular die 33 for shaping the outer peripheral surface of the processed product 101 is fixed to the top surface of a support table 32 of the lower die base 31. An annular outer ejector 35 is arranged along the inner periphery of the die 33 to be movable in the vertical direction. The outer ejector 35 is supported by the support table 32 through a plurality of elastic members 36. Each of the elastic members 36 is configured identically with each of the elastic members 16. An inner ejector 37, which has a columnar shape and serves as a restraint member adapted for arrangement in the space in the recess 104 of the processed product 101, is provided along the inner periphery of the outer ejector 35 to be movable in the vertical direction. The inner ejector 37 is supported by the support table 32 through a plurality of elastic members 38. The inner ejector 37 is urged in the direction opposite to the stamping direction in which the upper die base 40 moves toward the lower die base 31. Accordingly, when free from pressure from above, the inner ejector 37 projects upward from the top surface of the die 33. Teeth 39, 47, which are meshed with each other, are formed in the inner periphery of the outer ejector 35 and the outer periphery of the inner ejector 37, respectively. The teeth 39, 47 are shaped in correspondence with the ratchets 105 of the processed product 101.

The upper die base 40 serving as a second die base of the second stamping press 2 is selectively raised and lowered by a non-illustrated drive mechanism. An annular die 42 opposed to the outer ejector 35 is fixed to the bottom surface of a support table 41 of the upper die base 40. The die 42 forms an outer peripheral surface 106 of the body portion 103 and a bottom surface 107 of the flange 102 of the processed product 101. An ejector 43 opposed to the inner ejector 37 is arranged along the inner periphery of the die 42 to be movable in the vertical direction. The ejector 43 is supported by a plurality of elastic members 44. An annular stripper 45 opposed to the die 33 is arranged around the outer periphery of the die 42 to be movable in the vertical direction. The stripper 45 is supported by a plurality of elastic members 46. Each of the elastic members 44, 46 is configured identically with each of the elastic members 22.

Figure 16:
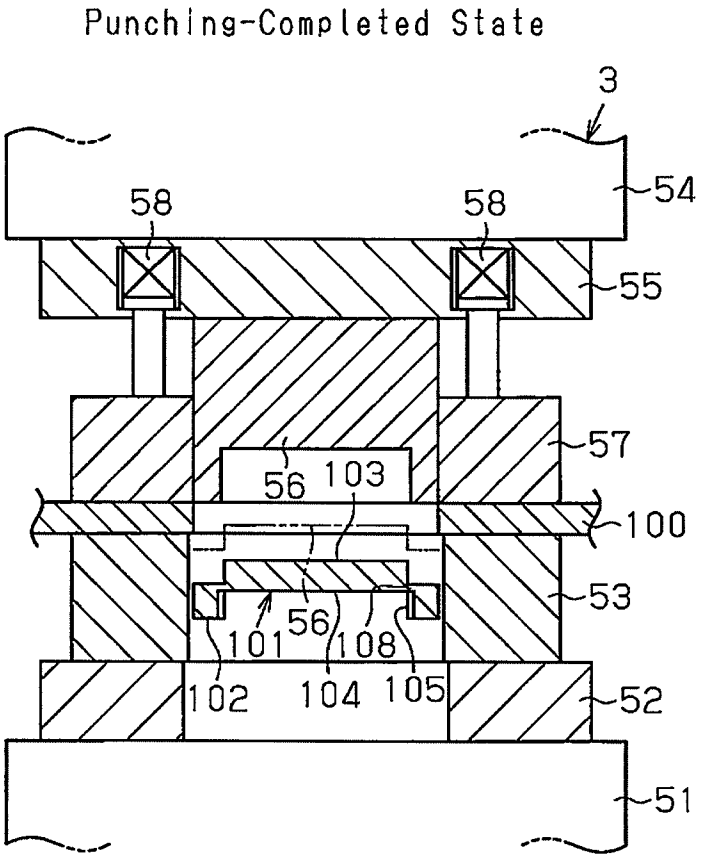
FIG. 16 is a cross-sectional view illustrating the third stamping press in a state in which separation of a workpiece is completed.
Figure 15:
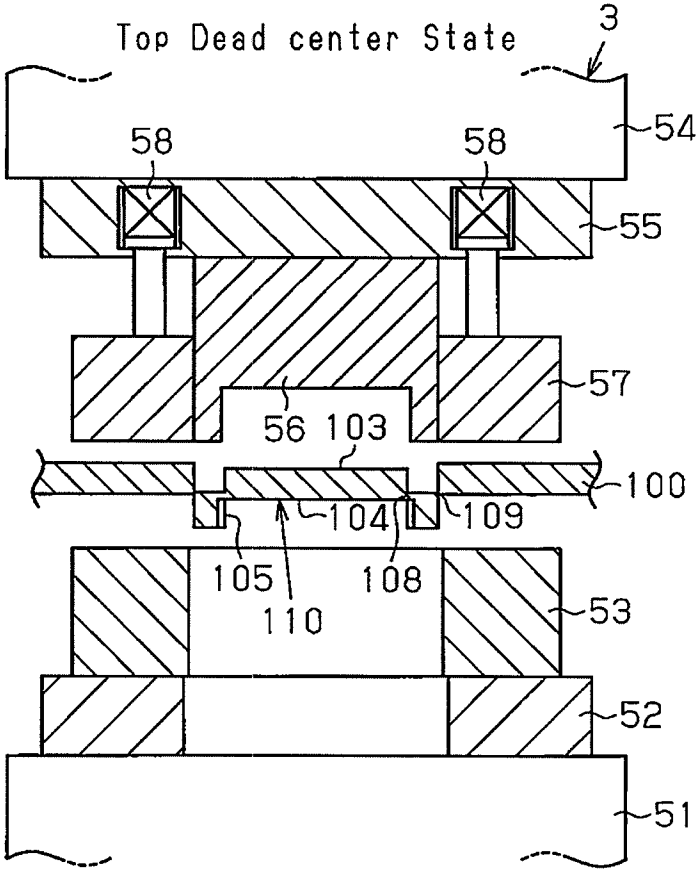
FIG. 15 is a cross-sectional view illustrating a third stamping press in a state in which an upper die base is located at an upper dead center position.
Figure 17:
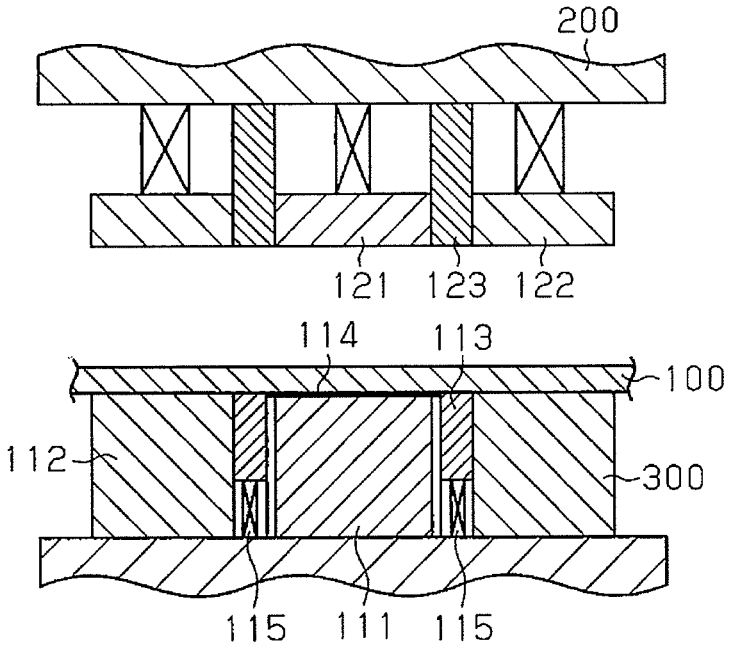
Fig.17 (Prior Art)
FIG. 17 is a cross-sectional view illustrating a conventional configuration in a state in which an upper die base is at a top dead center position.
Figure 18:
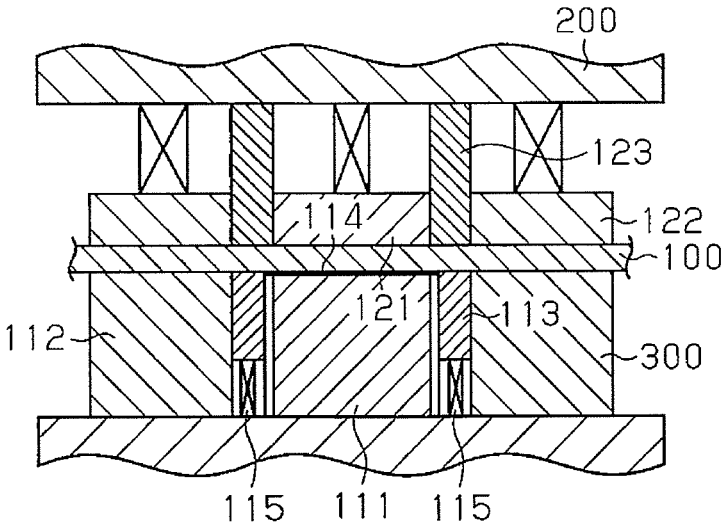
Fig.18 (Prior Art)
FIG. 18 is a cross-sectional view illustrating the conventional configuration in a state in which a workpiece is clamped between the upper die base and a lower die base.
Figure 19:
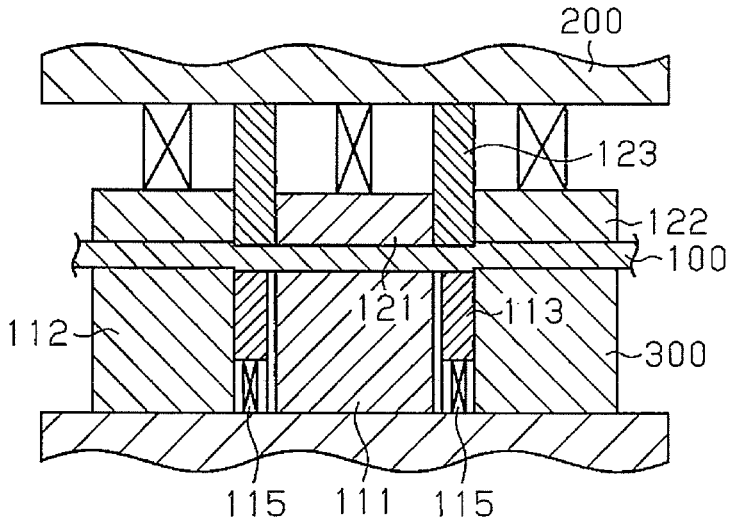
Fig.19 (Prior Art)
FIG. 19 is a cross-sectional view illustrating the conventional configuration in a state in which stamping of the workpiece is initiated.
Figure 20:
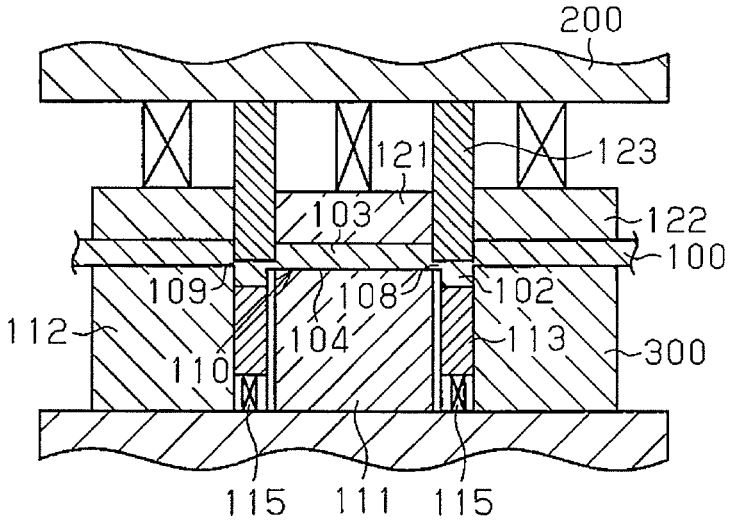
Fig.20 (Prior Art)
FIG. 20 is a cross-sectional view illustrating the conventional configuration in a state in which the stamping of the workpiece is completed.

As illustrated in FIGS. 15 and 16, a third stamping press 3 has a fixed lower die base 51. An annular die 53 is fixed to a support table 52 of the lower die base 51. An upper die base 54 of the third stamping press 3 is selectively lifted and lowered by a non-illustrated drive mechanism. A circular punch 56 is fixed to a support table 55 of the upper die base 54. Using the punch 56 and the die 53, the processed product portion 110 is separated from the workpiece 100. An annular stripper 57 opposed to the die 53 is arranged around the outer periphery of the punch 56 to be movable in the vertical direction. The stripper 57 is supported by a plurality of elastic members 58. Each of the elastic members 58 is configured identically with each of the elastic members 44, 46.

A stamping method using the stamping apparatus having the above-described configuration will hereafter be described.

Figure 4:
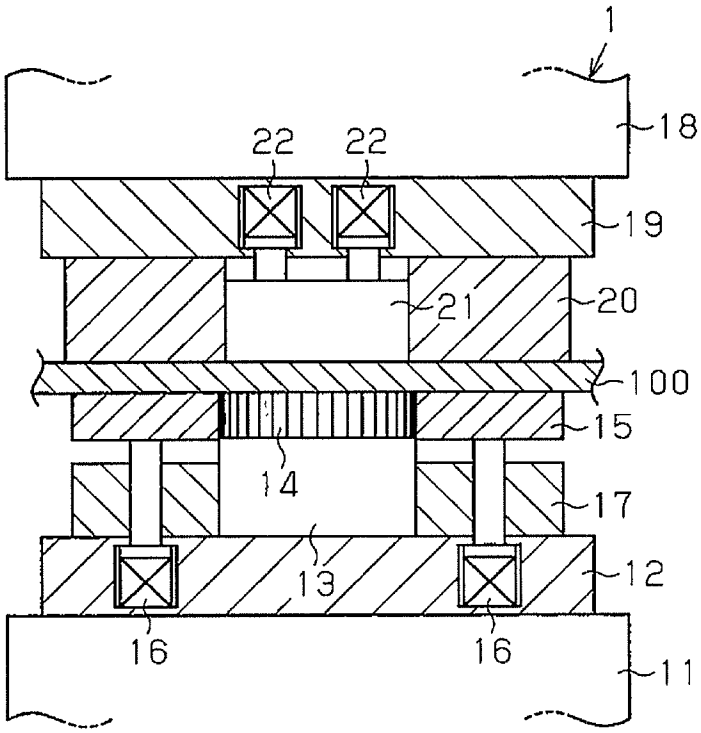
FIG. 4 is a cross-sectional view illustrating the first stamping press in a state in which a workpiece is clamped between the upper die base and a lower die base.
Figure 5:
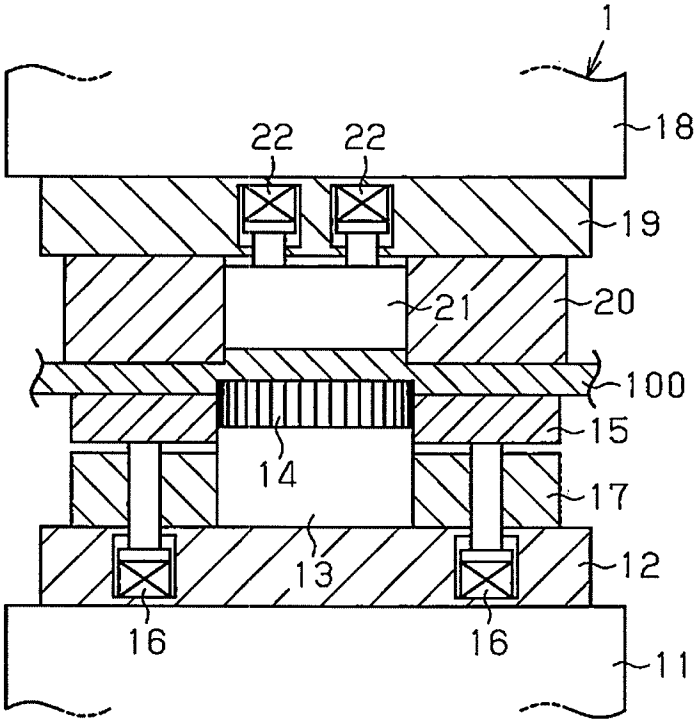
FIG. 5 is a cross-sectional view illustrating the first stamping press in a state in which stamping of the workpiece is initiated.
Figure 7:
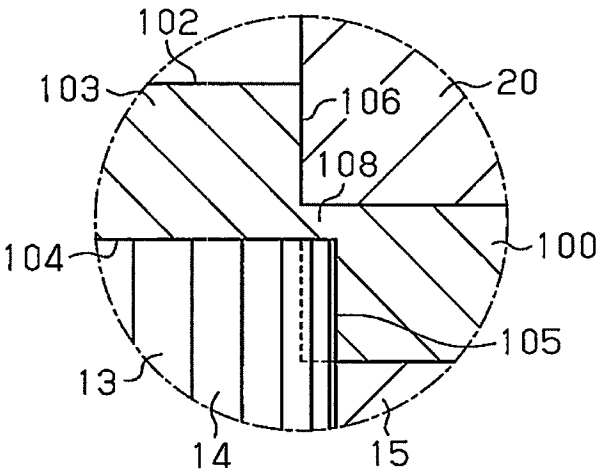
FIG. 7 is an enlarged cross-sectional view showing a portion of the workpiece in the state illustrated in FIG. 6.

With reference to FIG. 3, when the upper die base 18 of the first stamping press 1 is located at the top dead center position, the plate-like workpiece 100, which is a continuous ribbon of material unwound from a coil, is fed to a position between the upper die base 18 and the lower die base 11. Subsequently, as illustrated in FIG. 4, the upper die base 18 is lowered to clamp the workpiece 100 between the upper die base 18 and the lower die base 11. Referring to FIGS. 5 and 6, the upper die base 18 is continuously lowered to form the body portion 103 through operation of the upper and lower dies 20, 13. When stamping is completed, the stripper 15 is lowered to the lowering limit defined by the stopper 17 and the ejector 21 is raised to the raising limit defined by the support table 19. In the stamping-completed state illustrated in FIGS. 6 and 7, the recess 104, the ratchets 105 in the inner periphery of the recess 104, and the outer peripheral surface 106 of the body portion 103 are formed in the workpiece 100. Simultaneously, the joint portion 108 is formed between the body portion 103 and the portion of the workpiece 100 around the outer peripheral portion of the body portion 103 in the workpiece 100. The step of forming the recess 104 in the workpiece 100 is a first step.

Figure 8:
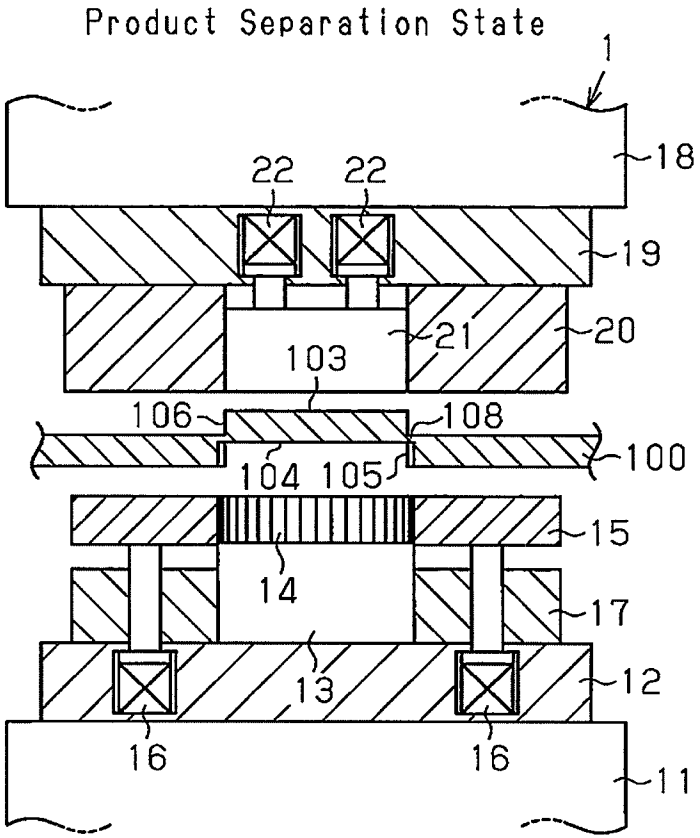
FIG. 8 is a cross-sectional view illustrating the first stamping press in a state in which the workpiece is removed.

After stamping, with reference to FIG. 8, the upper die base 18 is raised to the top dead center position and the stripper 15 moves upward. This causes the stripper 15 to separate the workpiece 100 upward from the die 13. Then, the workpiece 100 is sent from the first stamping press 1 for a subsequent step.

Figure 9:
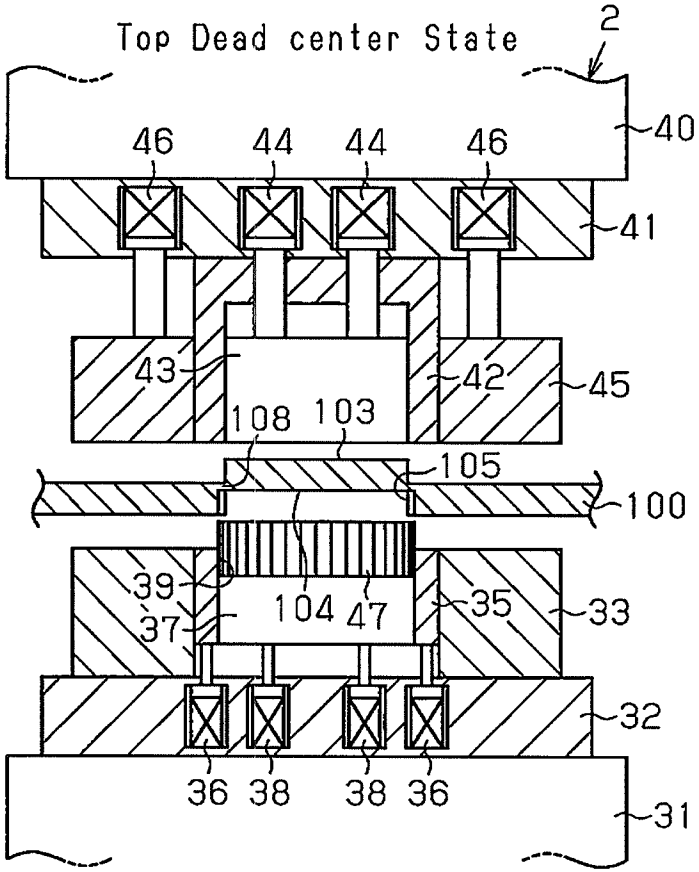
FIG. 9 is a cross-sectional view illustrating a second stamping press in a state in which an upper die base is located at a top dead center position.

The workpiece 100 is then transported to the second stamping press 2 for the subsequent step, which is illustrated in FIGS. 9 to 14. Referring to FIG. 9, the workpiece 100 is arranged between the upper die base 40 and the lower die base 31 of the second stamping press 2.

Figure 10:
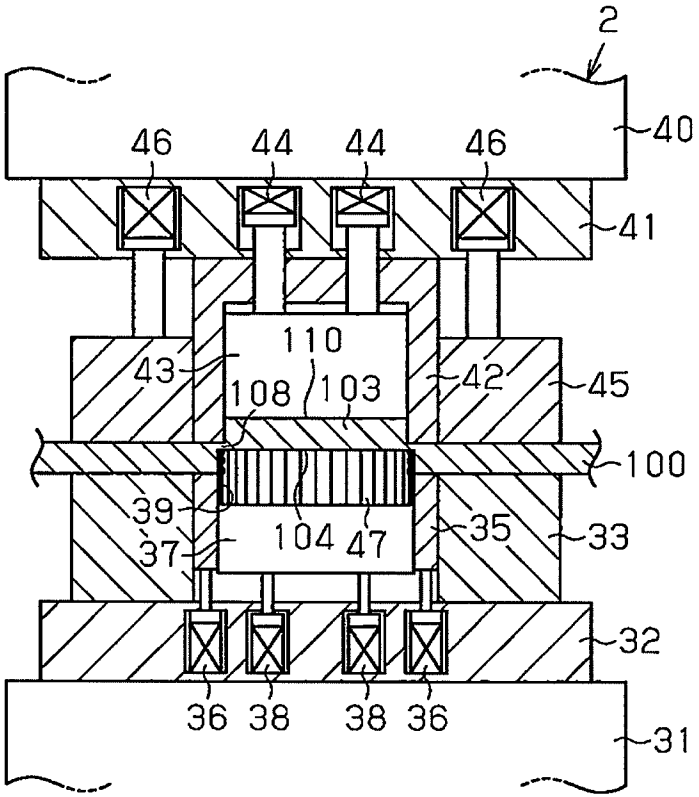
FIG. 10 is a cross-sectional view illustrating the second stamping press in a state in which stamping of a workpiece is initiated.

Subsequently, as illustrated in FIG. 10, the upper die base 40 is lowered to clamp the workpiece 100 between the upper die base 40 and the lower die base 31. At this stage, the inner ejector 37 of the lower die base 31 enters the space in the recess 104 using repulsive force produced by the elastic members 38. The inner ejector 37 becomes engaged with the recess 104 and thus supports the workpiece 100. In this state, the teeth 47 of the inner ejector 37 and the ratchets 105 are meshed together. The step of engaging the inner ejector 37, which corresponds to the restraint member, with the recess 104 is a second step.

Figure 12:
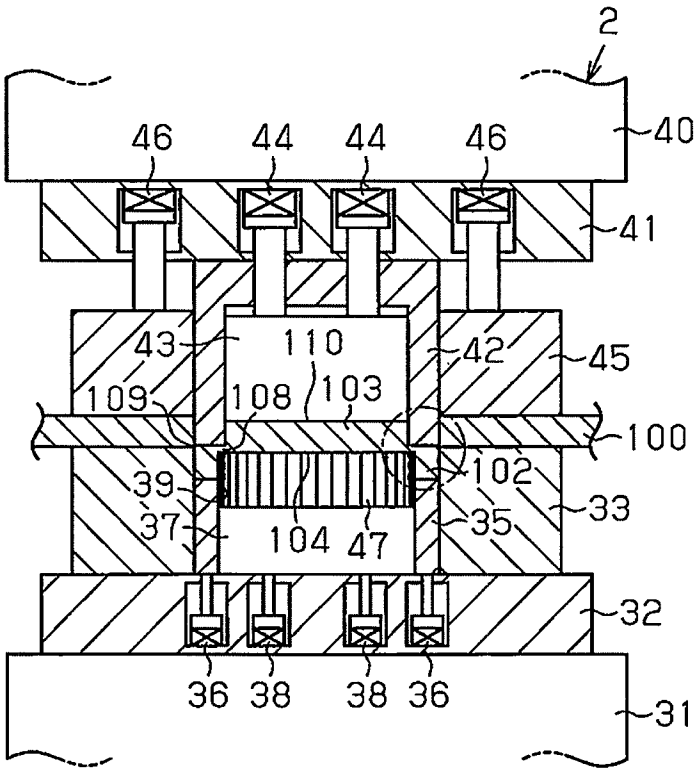
FIG. 12 is a cross-sectional view illustrating the second stamping press in a state in which the stamping of the workpiece is completed.
Figure 11:
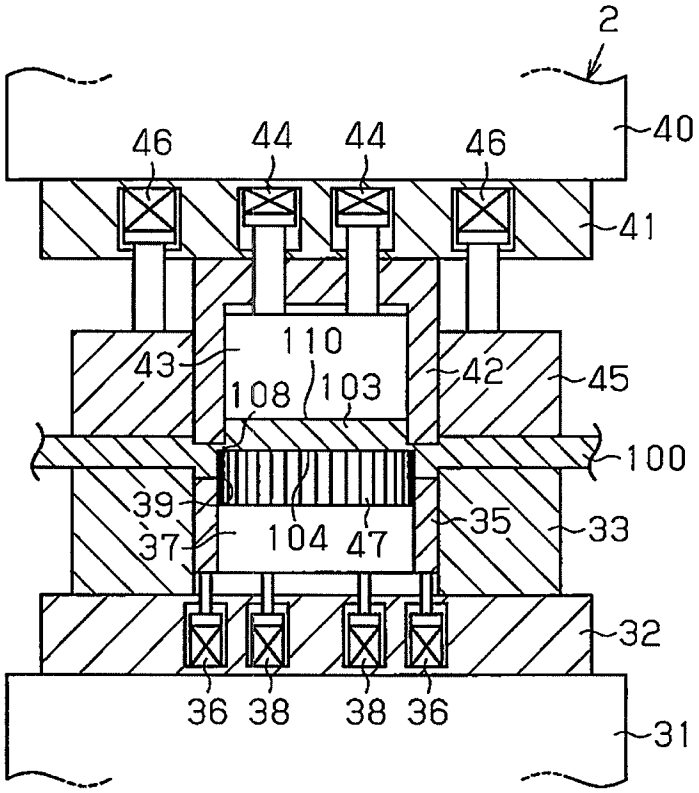
FIG. 11 is a cross-sectional view illustrating the second stamping press in a middle state of the stamping of the workpiece.
Figure 13:
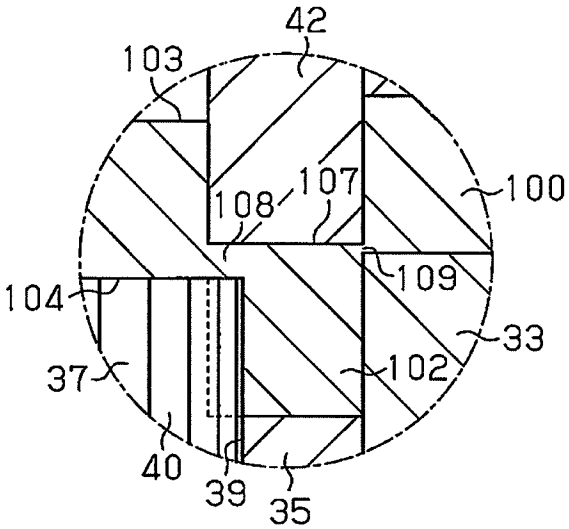
FIG. 13 is an enlarged cross-sectional view showing a portion of the workpiece in the state illustrated in FIG. 12.

Subsequently, as illustrated in FIGS. 11 and 12, the upper die base 40 is continuously lowered with the workpiece 100 supported by the inner ejector 37, thus lowering the die 42. This lowers the body portion 103 of the workpiece 100 such that the inner ejector 37 engaged with the recess 104 moves downward while supporting the portion corresponding to the recess 104 against the repulsive force generated by the elastic members 38. Simultaneously, the die 42 of the upper die base 40 forms the bottom surface 107 of the flange 102. In other words, as illustrated in FIGS. 11 to 13, by lowering the die 42 together with the upper die base 40, the outer ejector 35 is moved downward while supporting the corresponding portion of the flange 102. The step of forming only the outer peripheral portion while restricting deformation of the body portion 103 according to the second step is a third step.

As the upper die base 40 moves downward, the distance between the upper die base 40 and the stripper 45 decreases and the elastic members 46 thus become compressed. Simultaneously, the die 42 moves downward relative to the stripper 45. This causes the die 42 to form the processed product portion 110 such that a non-stamped portion of the processed product portion 110 is located upward relative to the processed product portion 110. The flange 102 is thus formed at an outer peripheral position of the processed product portion 110. Simultaneously, the joint portion 109, the thickness of which is less than the thickness of the inner joint portion 108, is formed between the flange 102 and the non-stamped portion of the workpiece 100, which is located at the outer periphery of the flange 102.

Figure 14:
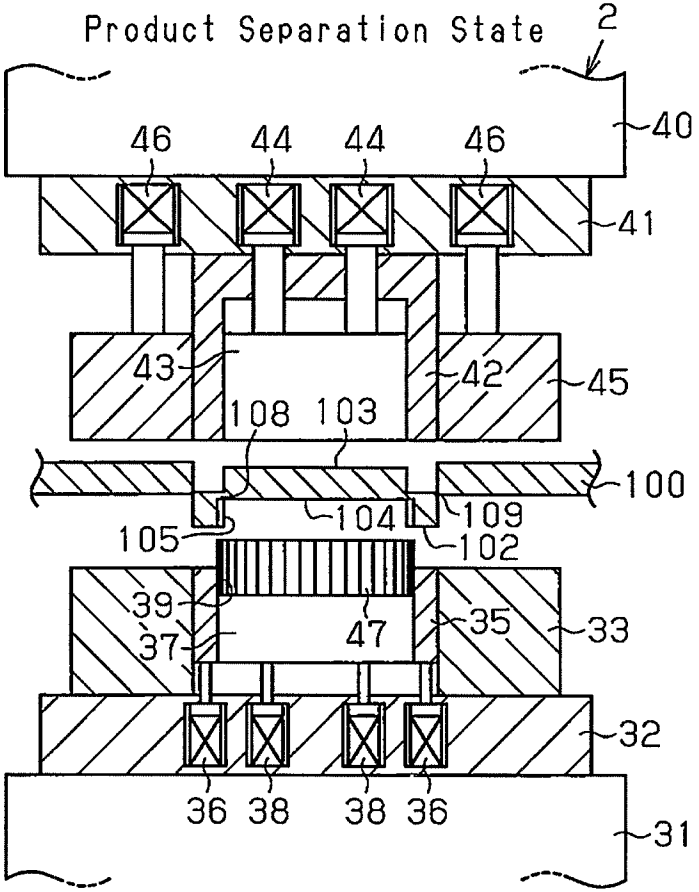
FIG. 14 is a cross-sectional view illustrating the second stamping press in a state in which the workpiece is separated.

Next, as illustrated in FIG. 14, the upper die base 40 is raised and returned to the top dead center position and the workpiece 100 is sent from the second stamping press 2 for a subsequent step.

The workpiece 100 is thus transported to the third stamping press 3, which is illustrated in FIGS. 15 and 16. In the third stamping press 3, the upper die base 54 is lowered to clamp the portion of the workpiece 100 other than the processed product portion 110 between the die 53 and the stripper 57. In this state, the punch 56 is moved into the die 53 to shear the processed product portion 110 at the position corresponding to the joint portion 109. This separates the processed product portion 110 from the workpiece 100, thus completing the processed product 101.

The present embodiment has the following advantages.

(1) In the present embodiment, the first stamping press 1 forms the recess 104 in the workpiece 100. The second stamping press 2 then applies shearing force to the outer peripheral portion of the processed product portion 110 while restricting deformation of the body portion 103 by engaging the inner ejector 37, which serves as the restraint member of the second stamping press 2, with the recess 104 of the workpiece 100. This ensures high-accuracy stamping while restricting deformation of the processed product portion 110. As a result, the processed product 101 having a desired shape and a desired size is obtained.

(2) The inner ejector 37, which is supported by the elastic members 38, is arranged in the second stamping press 2. Through such simple configuration, the processed product 101 with improved accuracy is obtained in the above-described manner.

(3) The step of shearing the joint portion 109 of the flange 102 is a step independent from the step of forming the flange 102. The independent step is performed by the third stamping press 3. This restrains burrs from being formed in the joint portion 109, thus improving the accuracy in the processed product 101. Also, a subsequent step such as a burr removal step becomes unnecessary.

The preferred embodiment may be modified as follows.

The method of the above illustrated embodiment may be carried out by using an apparatus for forming a processed product 101 having a recess 104 and a flange 102 each having a shape different from the corresponding shapes illustrated in FIGS. 1 and 2.

The up-down stroke of the second stamping press 2 may be set greater than that in the above illustrated embodiment. In this case, the outer joint portion 109 is sheared by the second stamping press 2.

The first stamping press 1 may include the die 42 of the upper die base 40 and the outer ejector 35 and the inner ejector 37 of the lower die base 31 of the second stamping press 2. In this manner, the first stamping press 1 is allowed to form the flange 102.

The upper die base and the lower die base of each of the stamping presses 1, 2, 3 may be arranged at the inverse positions in the up-down direction or each be held in a posture rotated by 90 degrees.

What is claimed is:

1. A forming method for stamping a workpiece with a stamping apparatus to obtain a processed product from a portion of the workpiece, the processed product having a body portion, an outer peripheral portion formed in an outer periphery of the body portion, and a recess formed in the body portion, the method comprising:

forming the body portion in the workpiece with a die such that the recess is formed in the body portion;

forming ratchets on an inner wall surface of the recess with teeth that are defined on an outer periphery of the die;

engaging, from a lower side of the workpiece, a restraint member with the formed ratchets in the recess to restrict deformation of the formed recess and the formed ratchets of the body portion; and forming the outer peripheral portion while the restraint member restricts deformation of the formed recess and the formed ratchets of the body portion.

2. The method according to claim 1, wherein the forming of the outer peripheral portion includes forming a flange in the outer peripheral portion.

3. The method according to claim 2, further comprising:

separating the processed product from the workpiece after forming the flange.

4. The method according to claim 1, wherein the stamping apparatus includes a first stamping press and a second stamping press, and the method further comprises:

feeding the workpiece to the first stamping press, wherein in the first stamping press, the forming of the recess and the forming of the ratchets is performed; and feeding the workpiece with the formed recess and the formed ratchets to the second stamping press, wherein in the second stamping press, the engaging of the restraint member with the formed ratchets and the forming of the outer peripheral portion is performed.

5. The method according to claim 4, wherein teeth are defined on an outer periphery of the restraint member, and engaging the teeth of the restraint member with the formed ratchets in the recess to restrict deformation of the body portion during the forming of the outer peripheral portion.

* * * * *